US007703547B2

(12) United States Patent
Manacorda et al.

(10) Patent No.: US 7,703,547 B2
(45) Date of Patent: Apr. 27, 2010

(54) HAND-HELD IMPACT TOOLS HAVING ANTI-VIBRATION PROTECTION

(75) Inventors: Thiago Prado Manacorda, São José dos Campos (BR); Nilton Luiz Menegon, São José dos Campos (BR); Ricardo Goncalves, São José dos Campos (BR)

(73) Assignee: Embraer—Empresa Brasileira De Aeronautica S.A., Sao Jose Dos Camps - SP (BR)

( * ) Notice: Subject to any disclaimer, the term of this patent is extended or adjusted under 35 U.S.C. 154(b) by 129 days.

(21) Appl. No.: 11/859,097

(22) Filed: Sep. 21, 2007

(65) Prior Publication Data

US 2008/0066939 A1 Mar. 20, 2008

Related U.S. Application Data

(63) Continuation-in-part of application No. PCT/BR2006/000113, filed on Jun. 8, 2006.

(30) Foreign Application Priority Data

Jun. 8, 2005 (BR) ..... 0504616

(51) Int. Cl.
*B25D 17/00* (2006.01)

(52) U.S. Cl. ..... 173/162.2; 173/169; 173/170; 16/431

(58) Field of Classification Search ..... 173/170, 173/162.1, 162.2, 210, 211, 171, 217, 169, 173/168, 93.5; 16/110.1, 431, 421, 435
See application file for complete search history.

(56) References Cited

U.S. PATENT DOCUMENTS 2,274,605 A * 2/1942 Hoffmeister ..... 16/411
2,425,245 A * 8/1947 Johnson ..... 16/431
3,918,530 A * 11/1975 Nyholm ..... 173/1

(Continued)

*Primary Examiner*—Scott A. Smith
(74) *Attorney, Agent, or Firm*—Nixon & Vanderhye P.C.

(57) ABSTRACT

Impact tools (e.g., riveters) are provided with anti-vibration protection by a cushion pad and an elastomeric sheath. The cushion pad may be formed of a shape-conformable elastomeric material which is adapted to being conformably placed onto a rear surface of the impact tool handle, while the elastomeric sheath is preferably sized and configured so as to removeably envelop the impact tool handle and the cushion pad. The cushion pad may have a widthwise dimension such that lateral edge regions of the cushion pad are adapted to being at least partly folded over and onto respective side surface portions of the impact tool handle. In some implementations, the cushion pad has a lengthwise dimension such that the cushion pad is adapted to being positioned adjacent to a rear end of the impact tool housing and extends therefrom to a position adjacent a lower surface of the impact tool handle. According to some implementations, the cushion pad may include an adhesive on at least a front surface thereof so as to be capable of being adhesively affixed to the rear surface of the impact tool handle. A releasable front sheet may be provided so as to cover the adhesive on the front surface thereof. Alternatively or additionally, the cushion pad may include an adhesive on a rear surface thereof and a releasable rear sheet covering the adhesive on the rear surface. The cushion pad may also have a patterned or unpatterned rear surface. The cushion pad may be formed of low density polyurethane foam, while the sheath may be formed of EPDM rubber.

10 Claims, 6 Drawing Sheets

U.S. PATENT DOCUMENTS 4,044,625 A * 8/1977 D'Haem et al. ..... 74/558.5
4,168,754 A * 9/1979 Nyholm ..... 175/325.2
5,244,521 A * 9/1993 Ligman ..... 156/85
5,267,487 A * 12/1993 Falco et al. ..... 74/558
5,347,684 A * 9/1994 Jackson ..... 16/421
5,353,474 A * 10/1994 Good et al. ..... 16/421
5,640,741 A * 6/1997 Yano ..... 16/421
6,155,354 A * 12/2000 Pusateri et al. ..... 173/170
6,161,256 A * 12/2000 Quiring et al. ..... 16/431
6,237,193 B1 * 5/2001 Skerker et al. ..... 16/430
6,247,204 B1 * 6/2001 Hamby et al. ..... 16/436
6,671,931 B1 * 1/2004 Duncan ..... 16/435
6,796,389 B2 * 9/2004 Pusateri et al. ..... 173/170
6,893,366 B2 * 5/2005 Falone et al. ..... 473/568
6,964,382 B2 * 11/2005 Alexander et al. ..... 239/526
7,334,298 B2 * 2/2008 Willat et al. ..... 16/435

* cited by examiner

HAND-HELD IMPACT TOOLS HAVING ANTI-VIBRATION PROTECTION

CROSS-REFERENCE TO RELATED APPLICATION AND PRIORITY CLAIMS

This application is a continuation-in-part of international application PCT/BR2006/000113 filed on 8 Jun. 2006 (published in the English language as WO 2006/130940 on 14 Dec. 2006), which international application designated the U.S. and claims benefit of Brazilian Application No. PI 0504616-5 filed on 8 Jun. 2005, the entire content of each of which is hereby incorporated by reference. Priority benefits are hereby claimed to each such prior-filed application.

TECHNOLOGICAL FIELD

The technology herein relates to hand-held impact tools, especially hand-held pneumatic riveters employed in the aircraft industry to assemble aircraft structural components. In preferred implementations, the present invention relates to kits and methods to provide such impact tools with anti-vibration protection and to the resulting anti-vibration protected impact tool.

BACKGROUND AND SUMMARY

A variety of hand-held impact tools are generally known. By way of example, hand-held pneumatic riveters are known and used conventionally by workers in the aircraft industry to assemble aircraft components. It of course can be readily understood that continual prolonged use of hand-held impact tools, such as pneumatic riveters, creates repetitive vibrations in the metacarpal region of a worker's hand thereby possibly resulting in discomfort. In order to alleviate such discomfort therefore some anti-vibration protection for the worker would be desirable. It is towards fulfilling such a need that the present invention is directed.

In some preferred implementations, an anti-vibration kit is provided so as to permit retrofitting of existing impact tools as well as permitting original equipment manufactures with an assembly by which anti-vibration properties may be provided to factory new tools. Preferably, the anti-vibration kit includes a cushion pad and an elastomeric sheath. The cushion pad may be formed of a shape-conformable elastomeric material which is adapted to being conformably placed onto a rear surface of the impact tool handle.

The elastomeric sheath is preferably sized and configured so as to removeably envelop the impact tool handle and the cushion pad. Thus, the elastomeric sheath serves as a cover member which may be removed so as to uncover the underlying cushion pad. The cushion pad may thus be replaced as needed in order to maintain its anti-vibration cushioning function.

The kit may advantageously be implemented in a form wherein the cushion pad has a widthwise dimension such that lateral edge regions of the cushion pad are adapted to being at least partly folded over and onto respective side surface portions of the impact tool handle. In some implementations, the cushion pad has a lengthwise dimension such that the cushion pad is adapted to being positioned adjacent to a rear end of the impact tool housing and extends therefrom to a position adjacent a lower surface of the impact tool handle.

According to some implementations, the cushion pad may include an adhesive on at least a front surface thereof so as to be capable of being adhesively affixed to the rear surface of the impact tool handle. A releasable front sheet may be provided so as to cover the adhesive on the front surface thereof. Alternatively or additionally, the cushion pad may include an adhesive on a rear surface thereof and a releasable rear sheet covering the adhesive on the rear surface. The cushion pad may also have a patterned or unpatterned rear surface.

The cushion pad may be formed of virtually any cushioning material. In some implementations, the cushion pad is formed of a low density polyurethane foam. The sheath may be formed of virtually any elastomeric material. In some implementations, the sheath is formed of EPDM rubber.

The sheath may include a tubular lower handle region for enveloping the impact tool handle. In order to assist in the positional maintenance of the lower handle region, the sheath may include an upper hood region joined to the lower handle region and adapted to covering a rear end of the impact tool housing. The hood region may have a forward facing opening sized and configured so as to accept therein the rear end of the impact tool housing, which opening may slat generally rearwardly relative to the impact tool.

An especially useful implementation of the herein disclosed subject matter is to provide a riveter (e.g., such as those conventionally employed in the aircraft industry to produce aircraft structural components) with anti-vibration properties by application of the anti-vibration kit.

One manner in which anti-vibration properties may be provided to an impact tool having a housing and a handle attached to the housing, comprises conformably positioning a cushion pad formed of a shape-conformable cushion material relative to a rear surface of the impact tool handle, and thereafter enveloping the cushion pad and the impact tool handle with an elastomeric sheath. The lateral edge regions of the cushion pad may at least partly folded over and onto respective side surface portions of the impact tool handle.

The cushion pad may be positioned adjacent to a rear end of the impact tool housing and adjacent the rear surface of the handle so that the cushion pad extends from the rear end of the impact tool housing to a position adjacent a lower surface of the impact tool handle.

The cushion pad include an adhesive on at least a front surface thereof so as to be capable of being adhesively affixed to the rear surface of the impact tool handle, and a releasable front sheet covering the adhesive on the front surface thereof. Thus, the method may comprise removing the front sheet so as to expose the adhesive on the front surface of the cushion pad and thereafter adhesively affixing the cushion pad to the rear surface of the impact tool handle so that the cushion pad conforms to the impact tool handle.

Alternatively or additionally, the cushion pad may include an adhesive on a rear surface thereof and a releasable rear sheet covering the adhesive on the rear surface. Thus, the method may comprise removing the rear sheet so as to expose the adhesive on the rear surface of the cushion pad and thereafter pulling the sheath over the cushion pad and impact tool handle so as to adhesively affix the sheath to the rear surface of the cushion pad. If present, the rear sheet is most preferably removed after the front surface of the cushion pad has been adhesively affixed to the rear surface of the impact tool handle prior to being enveloped by the sheath.

The sheath may be positionally maintained by pulling an upper hood portion of the sheath over a rear end of the impact tool housing.

These and other features and advantages will be better and more completely understood by referring to the following detailed description of exemplary non-limiting illustrative implementations in conjunction with the drawings.

BRIEF DESCRIPTION OF THE DRAWINGS

An exemplary non-limiting illustrative implementation of the herein disclosed subject matter will be further explained by reference to the drawings of which.

DETAILED DESCRIPTION

The exemplary illustrative non-limiting implementations herein relate to hand-held impact tools, especially hand-held pneumatic riveters provided with vibration protection employed in the aircraft industry to assemble aircraft structural components. Thus, although reference has been and will be made to pneumatic riveters that may be employed for the assembly of aircraft structural components, it will be understood that such a reference is a preferred implementation of the subject matter herein disclosed. Thus, it will be understood that the anti-vibration kits and methods may equivalently be employed on other hand-held tools (e.g., nail guns, staple guns, impact drills, impact wrenches and the like) to achieve vibration protection and/or to improve comfort to the user when the tool is held.

Figure 1:
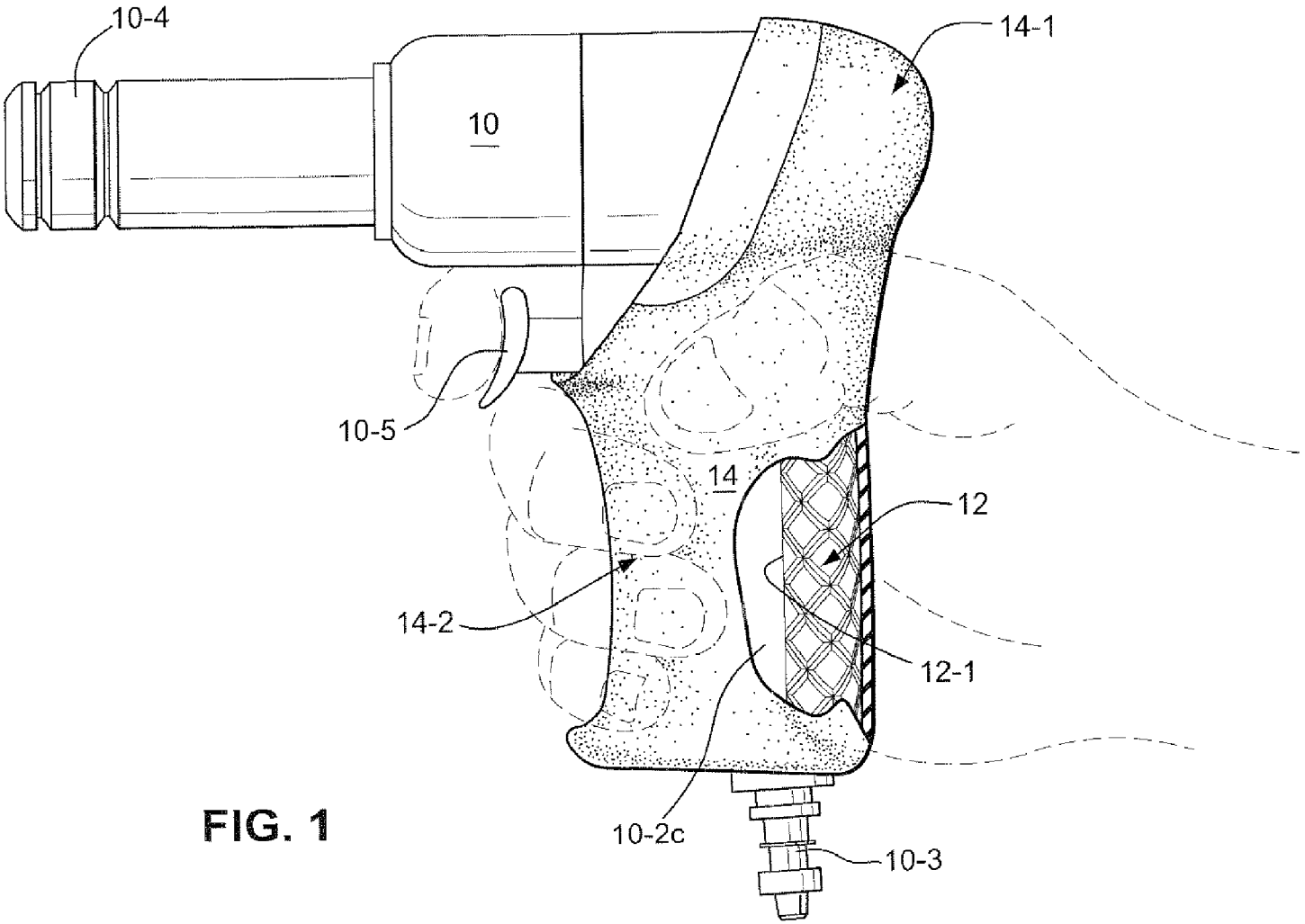
FIG. 1 is a side elevation view, partly in section, of an exemplary pneumatic hand-held riveter having vibration protection provided by an anti-vibration pad and elastomeric sheath assembly.

Accompanying FIG. 1 shows a hand-held impact tool in the form of a conventional hand-held riveter 10 provided with vibration protection in the form of an anti-vibration cushion pad 12 and an elastomeric sheath 14 which covers the pad 12. In preferred embodiments, the cushion pad 12 has a sufficient lengthwise dimension so as to be positioned adjacent to a rear end of the riveter housing 10-1 and extend therefrom along the rear surface 10-2*a* of the riveter handle 10-2 to a location at or near the bottom surface 10-2*b* of the handle 10-2 (see FIG. 3A). The exemplary riveter 10 depicted in FIG. 1 is pneumatically operated and thus includes a conventional nipple 10-3 for connection to a quick-disconnect coupling associated with a pressurized air supply hose (not shown). As is well known, the nose piece 10-4 of the riveter 10 drives a rivet upon pneumatic operation thereof when the riveter trigger 10-5 is actuated.

Figure 3A:
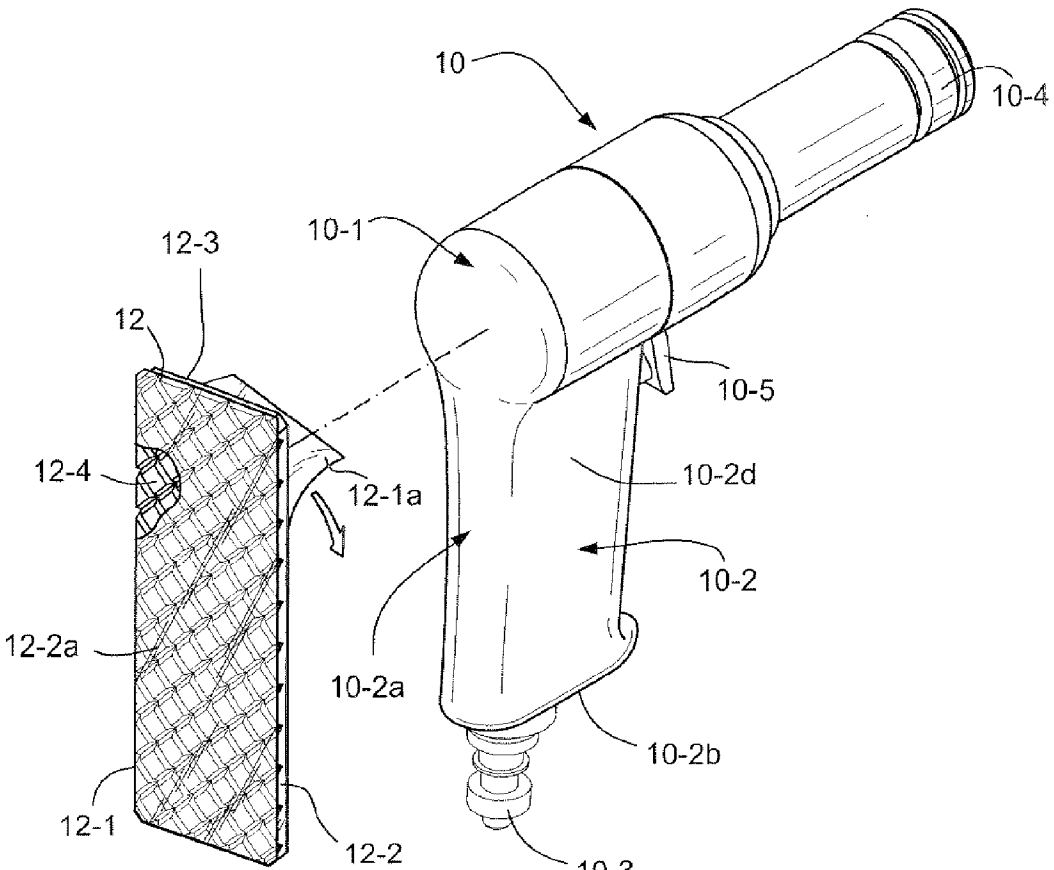
FIGS. 3A-3F depict sequentially the manipulative steps by which vibration protection may be provided to an impact tool by virtue of an anti-vibration kit.

The cushion pad 12 most preferably also has a sufficient widthwise dimension so that opposed lateral edge regions 12-1, 12-2 are capable of being folded into adjacent contact with the side surfaces 10-2*c*, 10-2*d* of the riveter handle 10-2 (only edge region 12-1 and side surface 10-2*c* being shown in FIG. 1, but see FIG. 3A).

Figure 2B:
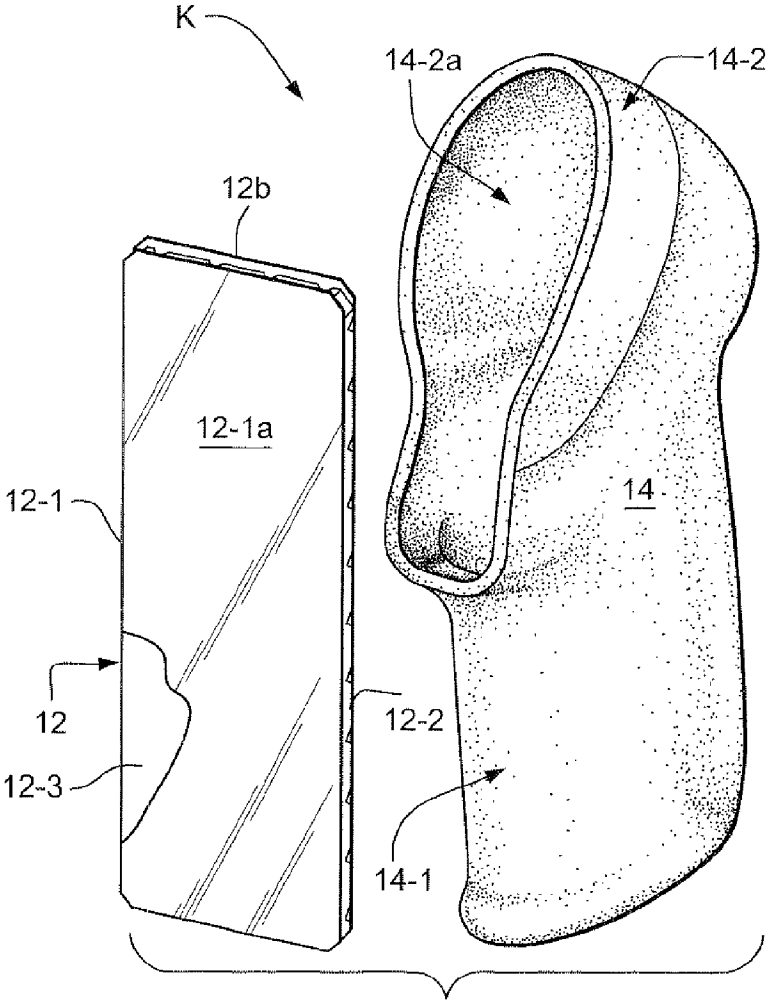
FIGS. 2A and 2B are rear and front perspective views, respectively, of an anti-vibration kit that may be applied to a hand-held impact tool as depicted in FIG. 1.
Figure 2A:
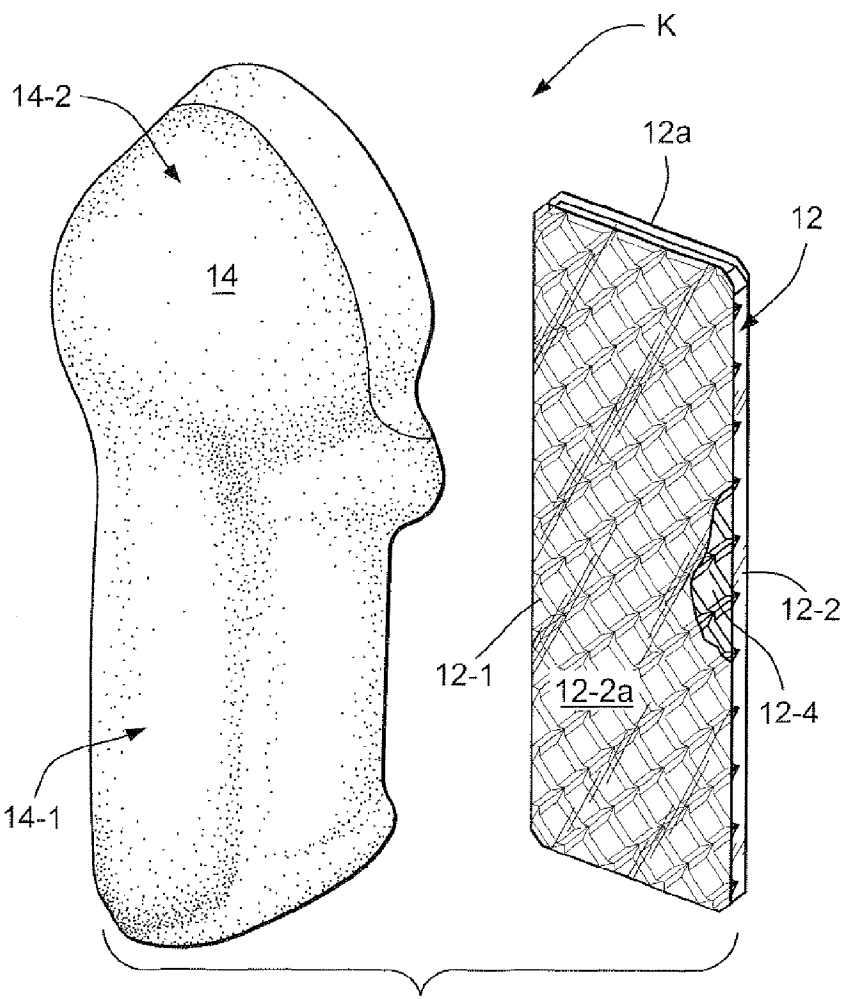
Figure 2C:
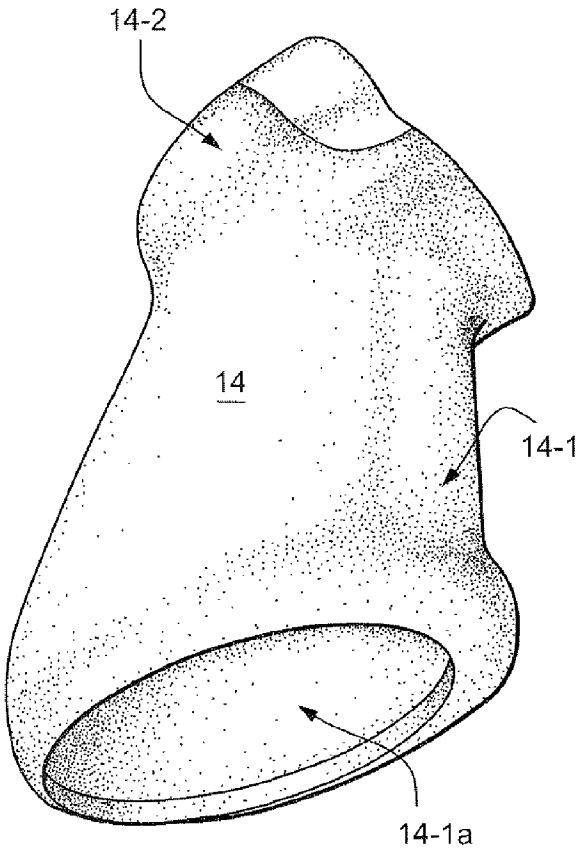
FIG. 2C is a bottom perspective view of an elastomeric sheath employed in the anti-vibration kit shown in FIGS. 2A and 2B.

The anti-vibration kit K which may be employed to provide anti-vibration properties to the riveter 10 is perhaps more clearly depicted in accompanying FIGS. 2A-2C. In this regard, it will be understood that the kit K may be employed in the first instance by original equipment manufactures (OEMs) to provide anti-vibration properties to factory new riveters 10. Alternatively or additionally, the kit K may be provided separately and used to retrofit existing riveters for vibration protection. Furthermore, the individual components of the kit K do not necessarily need to be packaged together, but instead could be separately purchased in bulk numbers and then withdrawn from inventory when needed to provide riveters 10 with vibration protection.

Regardless of its actual commercial form, the kit K to provide vibration protection to the riveter 10 will include the cushion pad 12 and the elastomeric sheath 14 as has already been discussed. In especially preferred implementations, the cushion pad 12 will include a pressure sensitive adhesive on front and rear surfaces 12-3, 12-4 covered by a removable sheet 12-1*a*, 12-2*a*, respectively. (It will be understood that a portion of the removable sheets 12-1*a*, 12-2*a* has been cut out of FIGS. 2A and 2B so as that the front and rear surfaces 12-3, 12-4, respectively, are more visible therein.) The removable sheets 12-1*a*, 12-2*a* may be formed of any suitable material compatible with the adhesive on the surfaces 12-3, 12-4, such as release papers (e.g., silicon treated papers), polymeric films, fabrics and the like. It is also sometimes preferable to have a relief pattern formed on the rear surface 12-4 of the cushion pad 12. If present, the pattern formed on the rear surface 12-4 of the cushion pad 12 could enhance the user's grip on the riveter handle 10-2 as the user could feel the pattern through the elastomeric sheath 14.

Virtually any material which provides the requisite anti-vibration properties when installed onto the riveter handle 10-2 may be employed satisfactorily in the practice of the preferred implementations of the herein disclosed subject matter. In this regard, the anti-vibration properties will in large part be dependent upon the type and/or thickness of the material employed to form the cushion pad 12. In preferred forms, the cushion pad 12 is made of a foam material, more preferably a flexible low density polyurethane foam material. A particularly preferred low density polyurethane foam material is commercially available from JOBE LUV (www.jobeluv.com.br). The flexible polyurethane foam that may be employed in the practice of the present invention may have a density of at least about 1.0 $lb/ft^3$ and usually at least about 5 $lb/ft^3$.

The cushion pad 12 must have a thickness which is sufficient to impart the desired anti-vibration properties to the riveter 10 when installed thereon. Thus, the thickness of the cushion pad cannot be too thin as this would not afford adequate anti-vibration properties. Conversely, the thickness of the cushion pad cannot be too thick as this would adversely affect the handling of the riveter tool by the user. As noted above, the thickness of the cushion pad 12 to provide the desired anti-vibration properties will depend upon the particular type of material from which it is made. By way of example only, if the cushion pad 12 is formed of a low density polyurethane foam material, then a thickness of between about 4 mm to about 10 mm is usually sufficient. In especially preferred embodiments, it has been found that a cushion pad 12 thickness of about 6 mm (+/− about 1 mm) will usually suffice.

The elastomeric sheath 14 is a unitary (one-piece) structure formed of virtually any elastomeric material that provides resilient stretch properties. In especially preferred embodiments, the elastomeric material forming the sheath 14 is an EPDM (ethylene propylene diene monomer) rubber. Unlike the cushion pad 12, the elastomer sheath 14 most preferably is relatively thin to allow it to be easily stretched over the riveter handle 10-2 during installation. Thus, the thickness of the sheath 14 in preferred implementations of the kit K will usually be less than about 4 mm (e.g., between about 0.5 mm to about 3 mm), and more preferably about 2 mm.

The elastomeric sheath 14 is generally a tubular structure having a lower handle region 14-1 and an upper hood region 14-2. The lower handle region 14-1 defines an opening 14-1*a* at its lower end so as to accommodate the connection nipple 10-3 of the riveter 10. (See FIG. 2C) The upper hood region 14-2 defines a relatively larger (relative to the opening 14-1*a*) forward facing opening 14-2*a* which slants generally rearwardly relative to the riveter 10. The opening 14-2*a* is sized and configured so as to accommodate the rear end of the riveter housing 10-1.

The hood region 14-2 therefore covers a rear end portion of the riveter housing 10-1 so as to provide a stirrup support function for the lower handle region 14-1. That is, by virtue of its covering a rear end portion of the riveter housing 10-1, the hood region 14-2 minimizes (or prevents entirely) movement of the lower handle region 14-1 of the sheath 14 during riveter use. Thus, the hood region 14-2 provides assistance to positionally maintain the lower handle region 14-1 relative to the cushion pad 12. In addition to (or in lieu of) the mechanical support provided by the hood region 14-2, the adhesive contact between the lower handle region 14-1 and the rear surface 12-2 of the cushion pad 12 will provide positional maintenance of the sheath 12.

Accompanying FIGS. 3A-3F depict schematically a presently preferred technique to install the kit K onto the riveter 10. in this regard, the cushion pad 12 is initially prepared for positioning and installation be removal of the protective sheet 12-1 a from the front surface 12-3 thereby exposing the pressure sensitive adhesive thereon. The cushion pad 12 may then be positioned adjacent the rear handle surface 10-2*a* of the riveter 10 as shown in FIG. 3A. Pressure applied to the cushion pad 12 while positioned in such a manner will allow the front surface 12-1 thereof to be adhesively affixed to the rear surface 10-2*a* of the riveter handle 10-2. In the embodiment depicted, the cushion member 12 is of sufficient length so that it may also be affixed adhesively to the rear end of the riveter housing 10-1. The lateral edge regions 12-1, 12-2 of the cushion member 12 may then be conformably folded onto and adhesively affixed to respective corresponding underlying portions of the side surfaces 10-2*c*, 10-2*d* of the riveter handle 10. (See FIG. 3C)

Figure 3C:
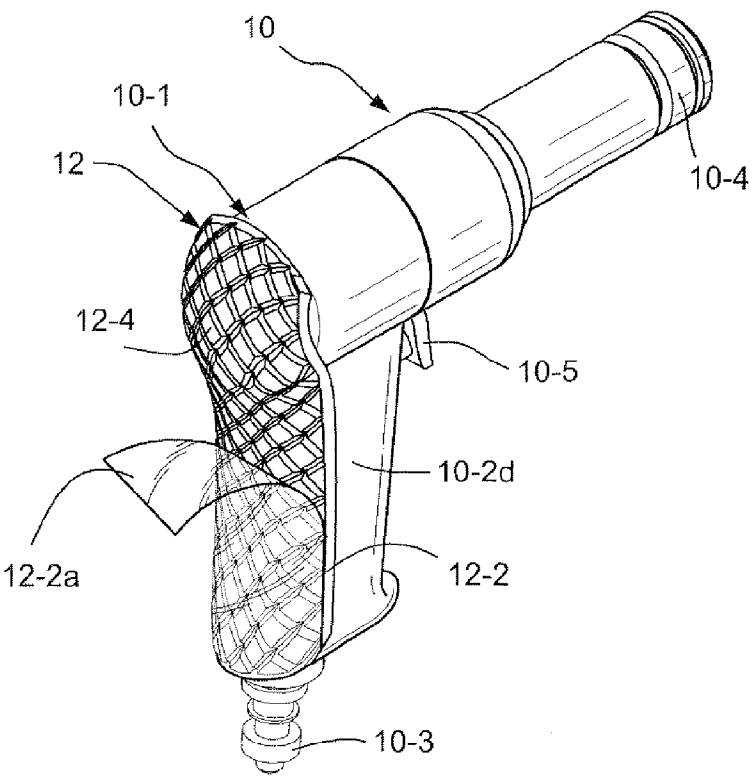
Figure 3B:
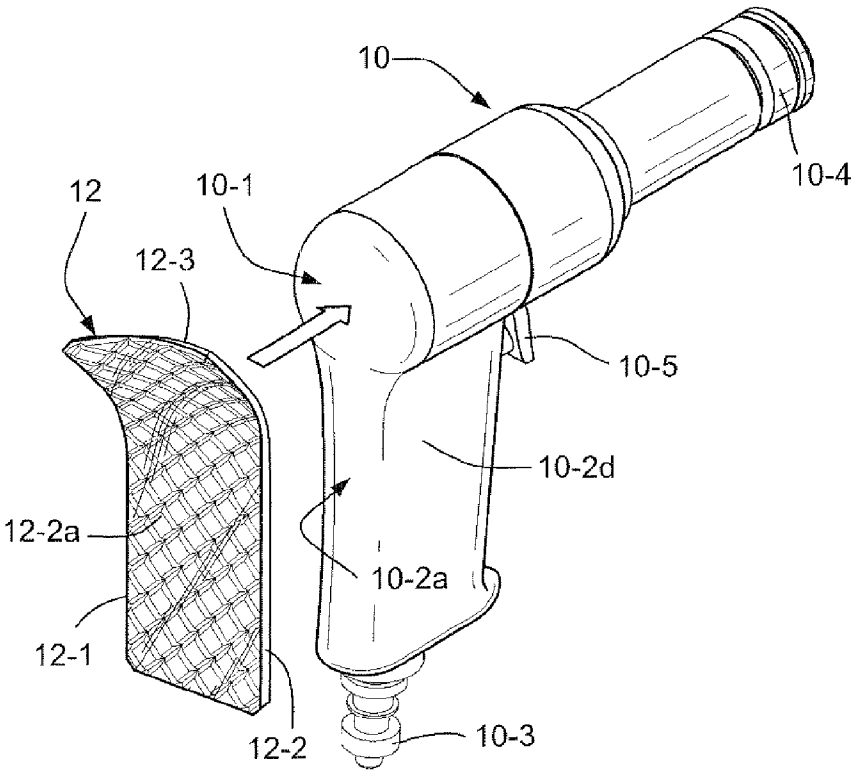
Figure 3E:
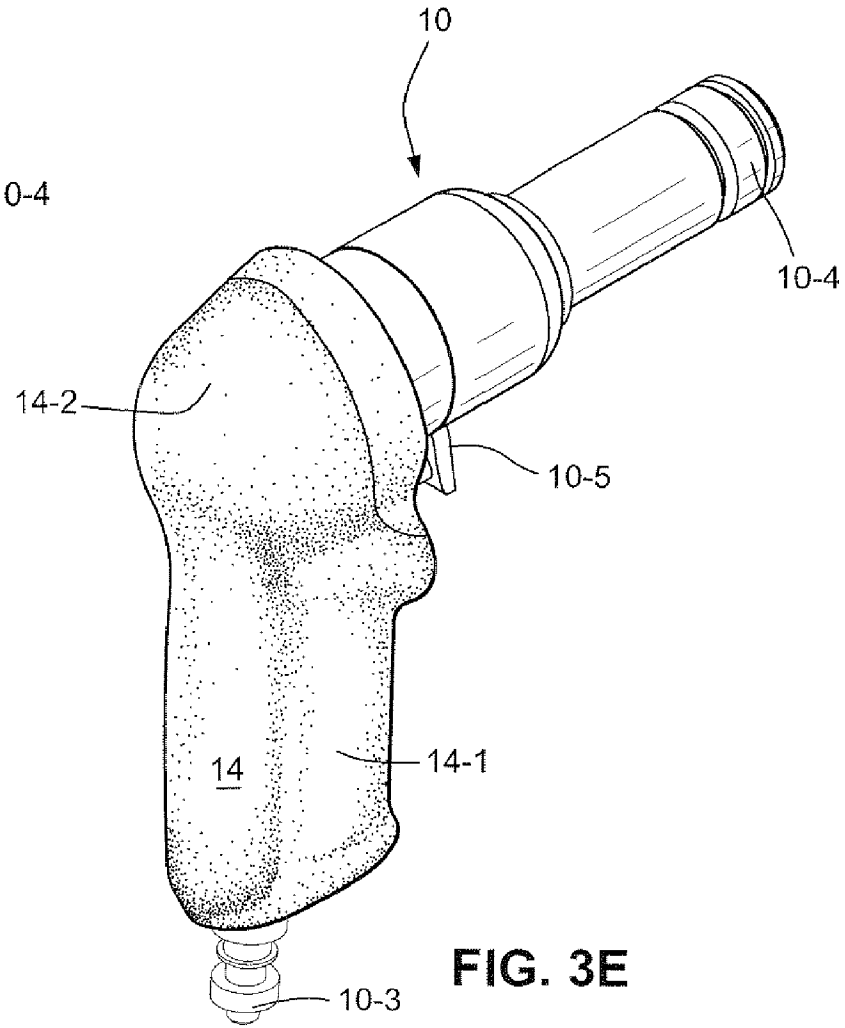
Figure 3D:
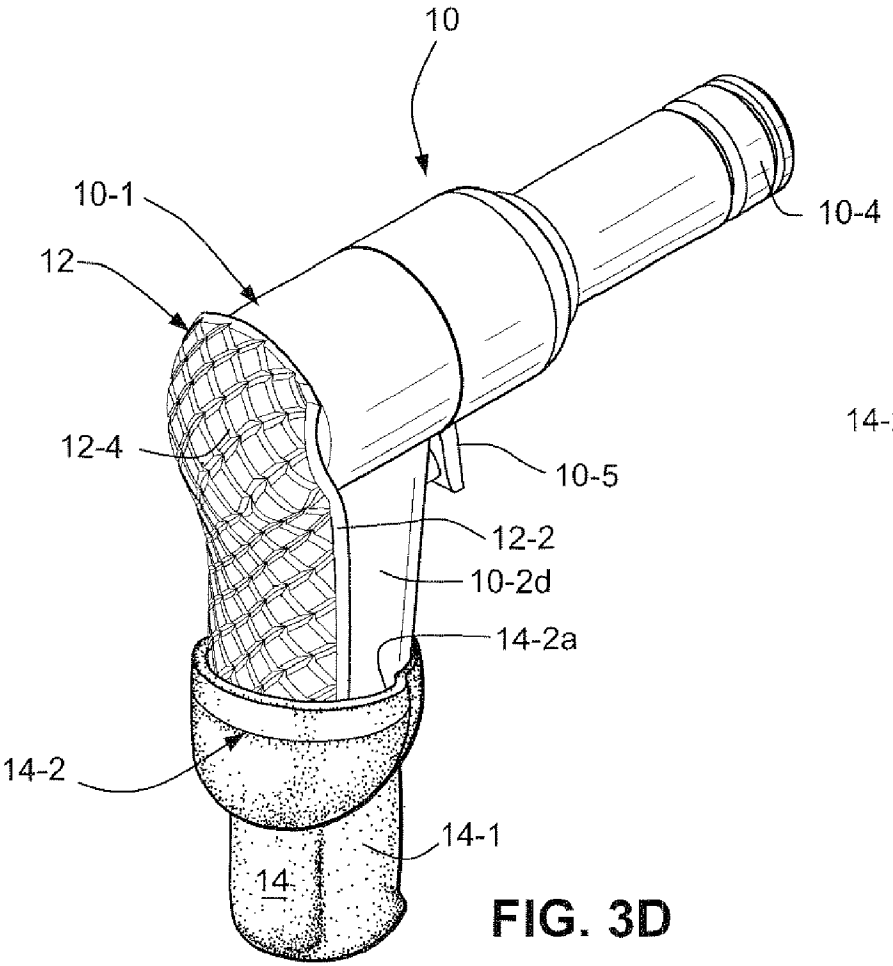
Figure 3F:
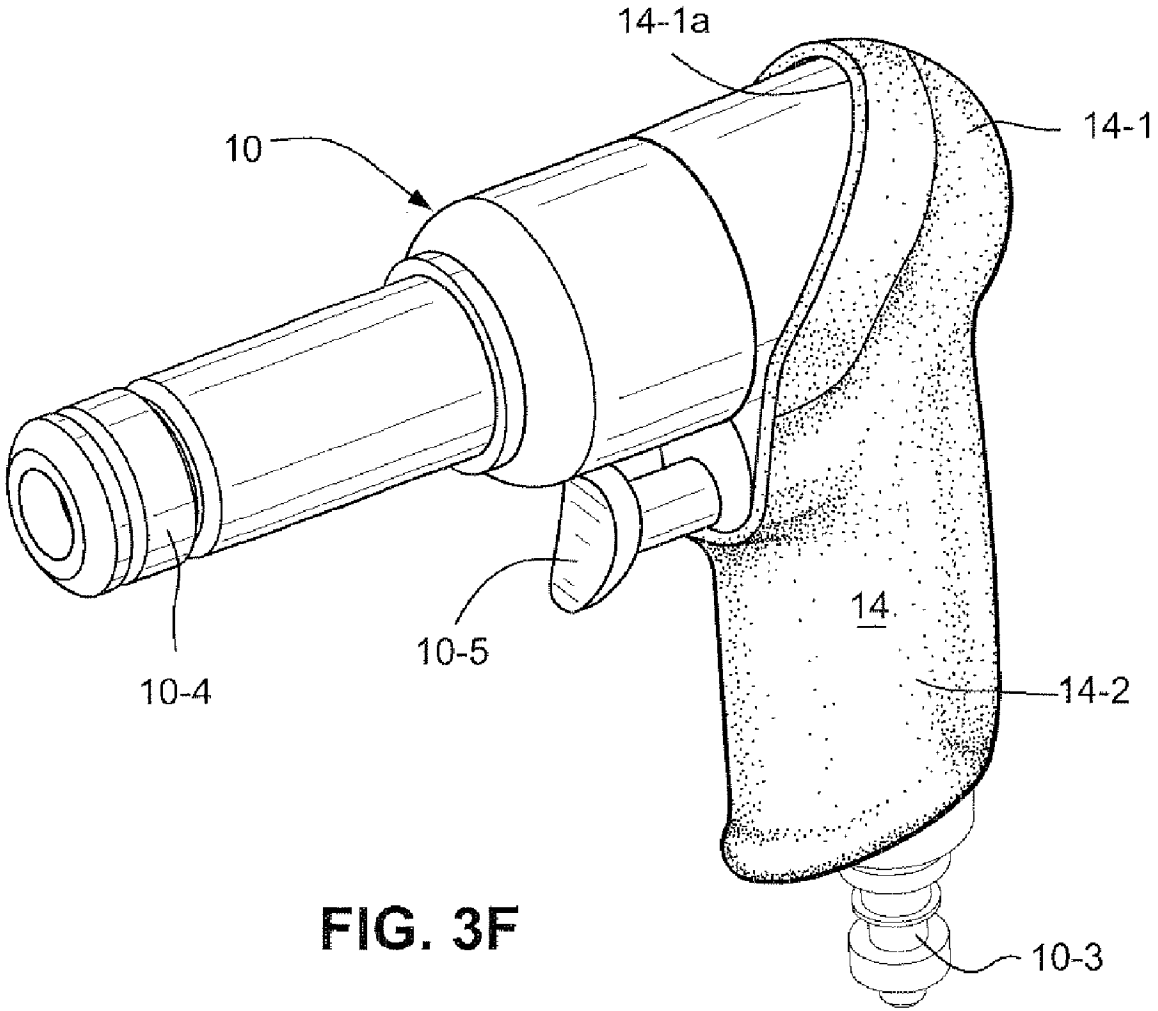

Once the cushion member 12 is affixed to the riveter 10 in the manner described previously, the sheet 12-2*a* covering the adhesive on the rear surface of the cushion pad 12 may be removed, if provided, as depicted in FIG. 3C. Thereafter, as shown in FIGS. 3D and 3E, the sheath 14 is pulled onto and over the riveter handle 10-2 so that the handle region 14-1 covers all of the riveter handle's surfaces. The hood region 14-2 may then be pulled onto and over the rear end portion of the riveter housing 10-1. Pressure against the handle region 14-1 will thereby adhesively affix the same to rear surface 12-2 of the cushion pad 12. The riveter 10 having the anti-vibration properties afforded by the kit K as shown in FIG. 3F may thus be placed into use.

EXAMPLE

A kit K as described herein was applied to a conventional riveter and tested for vibration levels before and after the kit application. The riveter without the anti-vibration kit exhibited a vibration level of 57.6 $m/s^2$. After application of the kit onto the riveter, a vibration level of only 2.27 $m^2$ was exhibited. Thus, by use of the kit K as described herein the vibration level of the riveter was reduced to well below the maximum amount of 8 $m/s^2$ permitted by Brazilian Health Standard NR15 (1978) and ISO 2631-2:2003 and ISO 5349-1:2001.

While the technology herein has been described in connection with exemplary illustrative non-limiting implementations, the invention is not to be limited by the disclosure. The invention is intended to be defined by the claims and to cover all corresponding and equivalent arrangements whether or not specifically disclosed herein.

The invention claimed is:

1. An impact tool comprising:

a housing having front and rear ends;

a handle having upper and lower ends and defining front and rear surfaces between the upper and lower ends, the handle being attached at the upper end thereof to the rear end of the housing such that the handle extends downwardly from the rear end of the housing;

a trigger positioned forwardly of the front surface of the handle below the housing; and an anti-vibration assembly comprising:

a cushion pad formed of a shape-conformable cushion material which is conformably positioned adjacent the rear surface of the handle, and an elastomeric sheath enveloping the cushion pad and the handle, wherein the sheath includes, a tubular lower handle region which envelopes the impact tool handle between the upper and lower ends thereof, and an upper hood region joined to the lower handle region which covers a rear end of the impact tool housing, wherein the hood region includes a forward facing opening sized and configured so as to accent therein the rear end of the impact tool housing, the opening of the upper hood region being slanted from a position at the front surface of the handle generally rearwardly toward the rear end of the housing to thereby provide a stirrup support for the sheath to thereby positionally maintain the cushion Dad relative to the rear surface of the handle.

2. An impact tool as in claim 1, wherein the cushion pad has a widthwise dimension such that lateral edge regions of the cushion pad are at least partly folded over and onto respective side surface portions of the impact tool handle.

3. An impact tool as in claim 2, wherein the cushion pad has a lengthwise dimension such that the cushion pad is positioned adjacent to the rear end of the impact tool housing and extends therefrom to a position adjacent the lower end of the handle.

4. An impact tool as in claim 1, wherein the cushion pad includes an adhesive on at least a front surface thereof so as to be adhesively affixed to the rear surface of the handle.

5. An impact tool as in claim 4, wherein the cushion pad includes an adhesive on a rear surface thereof so as to be adhesively affixed to the sheath.

6. An impact tool as in claim 4, wherein the impact tool is a riveter.

7. An impact tool as in claim 1, wherein the handle includes a connection nipple extending outwardly from the lower end thereof, and wherein the lower handle region of the sheath defines an opening to accommodate the outwardly ending connection nipple.

8. An impact tool as in claim 1, wherein cushion pad has a thickness between about 4 mm to about 10 mm.

9. An impact tool as in claim 8, wherein the cushion pad comprises a polyurethane foam.

10. An impact tool as in claim 1, wherein the sheath has a thickness of less than about 4 mm.

* * * * *